US005419267A

United States Patent [19]

Raiko

[11] Patent Number: 5,419,267

[45] Date of Patent: May 30, 1995

[54] METHOD AND APPARATUS FOR DRYING THE FUEL OF A FLUIDIZIED-BED BOILER

[75] Inventor: Markku Raiko, Hyvinkää , Finland

[73] Assignee: Imatran Voima Oy, Helsinki, Finland

[21] Appl. No.: 244,193

[22] PCT Filed: Nov. 18, 1992

[86] PCT No.: PCT/FI92/00310

§ 371 Date: May 26, 1994

§ 102(e) Date: May 26, 1994

[87] PCT Pub. No.: WO93/11388

PCT Pub. Date: Jun. 10, 1993

[30] Foreign Application Priority Data

Nov. 27, 1991 [FI] Finland ..... 915577

[51] Int. Cl.[6] ..... F23G 7/00

[52] U.S. Cl. ..... 110/245; 122/4 D; 34/379

[58] Field of Search ..... 34/333, 379; 110/245, 110/224, 227, 228; 422/159; 122/4 D; 432/58

[56] References Cited

U.S. PATENT DOCUMENTS

| | | | |
|---|---|---|---|
| 4,047,883 | 9/1977 | Waters | 432/14 |
| 4,424,766 | 1/1984 | Boyle | 122/4 D |
| 4,474,119 | 10/1984 | Jones | 110/245 |
| 4,690,076 | 9/1987 | Peletz, Jr. et al. | 110/245 X |
| 5,159,886 | 11/1992 | Schaub et al. | 110/245 X |

*Primary Examiner*—Denise L. Gromada

*Attorney, Agent, or Firm*—Birch, Stewart, Kolasch & Birch

[57] ABSTRACT

The present publication discloses a method and an apparatus for drying the fuel used for firing a fluidized-bed boiler (1). The hot, inert solids of the fluidized bed are circulated by a regulated rate from the furnace (2) to a simple dryer (11) incorporated into the fuel feed line (7) to the boiler (1), whereby the fuel is dried and steam is generated. By virtue of controlled bed solids recirculation, a constant temperature of the dryer (11) can be maintained, thus permitting the omission of all heat transfer surfaces from the dryer (11). The nearly clean steam released from the drying process is routed from the dryer (11) to useful applications. (FIG. 1)

10 Claims, 2 Drawing Sheets

METHOD AND APPARATUS FOR DRYING THE FUEL OF A FLUIDIZIED-BED BOILER

The present invention relates to a method and apparatus for drying the fuel used for firing a fluidized-bed boiler. The fuel is dried in a dryer incorporated in the fuel feed line, prior to the feed of the fuel to the fluidized-bed boiler, so that recirculated bed solids can be employed for drying the fuel. The bed solids recirculation rate is controlled so as to supply the dryer only with such an amount of hot bed solids as is necessary for drying the contained fuel. The bed solids are mixed in the dryer with wet fuel, whereby the moisture content of the fuel is lowered and steam is generated. The mix of the dried fuel and bed solids is fed into the boiler furnace. The steam generated in the drying process can be routed from the dryer to useful applications, advantageously to a condensing stage and, thereby, for use in energy generating processes.

BACKGROUND OF THE INVENTION

In pulverized-fuel fired power plants, the wet fuel is generally dried with the help of stack gases prior to being fed into the furnace of the boiler. The drying of the fuel is necessary, because burners of pulverized fuel require dry fuel for stable combustion. In fluidized-bed boilers, the fuel need not be dry for efficient combustion, but rather, drying and combustion can take place in the fluidized bed, whose heat content is relatively high.

In drying with stack gases, the stack gases and the steam generated in the drying process will become mixed with each other. Heat recovery from the gaseous mix of the stack gases and the steam emerging from the drying process in not generally economically feasible, because the heat of condensation cannot be recovered at a sufficiently high temperature, and moreover, the acidic components ($NO_x$ and $SO_x$) of the stack gases cause strong corrosion of the heat exchanger surfaces at temperatures below the dew point of water.

The fuel can be dried for pulverized fuel firing also with the help of different steam-heated dryers in which the heat for drying is obtained from steam fed to the dryer. The steam is condensed on heat transfer surfaces designed into the dryer. Typically, low-pressure steam is used at a temperature as low as possible, and the steam released from the fuel is not necessarily recovered.

An advantageous steam-heated dryer construction known in the art is a fluidized-bed steam-heated dryer in which the pressure level of dryer exhaust steam is first elevated by means of a compressor and the compressed steam is then introduced to the steam-condensing surfaces of the dryer, whereby the heat of condensation can be recovered from the exhaust steam. The drawbacks of such a dryer are its high investment costs and relatively high internal power consumption of the compressor.

The German application publication DE 3,726,643 discloses a construction whose use is limited to circulating fluidized-bed boilers, in which the entire flow of the circulating bed solids is routed to the mixer-type dryer. Typical to commercial circulating fluidized-bed boilers, also this system uses a heat exchanger construction with cooling surfaces as the dryer. In the embodiment described in the DE application publication, recirculated steam acts as the fluidizing gas. The dryer is provided with heat transfer surfaces, because the amount of recirculated bed solids cannot be controlled to match the required drying effect. Cooling of the recirculated bed solids thus takes places in three different stages: drying of fuel, superheating of recirculating steam and heat transfer to cooling tubes placed in the dryer bed.

The abovedescribed system still has the drawback of complicated dryer construction and process arrangement, which cause high investment costs. Furthermore, for efficient heat transfer, the bed temperature of the dryer in such an embodiment must be clearly higher (by 100°. . . 300° C.) than the phase transition temperature necessary for evaporation of water into steam, whereby fuel gasification and tar formation may hamper the technical feasibility of the apparatus.

SUMMARY OF THE INVENTION

The present invention is not limited to fluidized-bed technology for the operation of the dryer. An essential characteristic of the dryer is that only such an amount of bed solids is admitted in a controlled manner into the dryer as is necessary to keep the dryer temperature at a desired level.

When a fluidized-bed dryer is operated according to the invention, the circulating exhaust steam generated in the drying process is not spent for cooling the bed as is the case in the embodiment according to the abovementioned DE publication, but rather, only for keeping the bed in a fluidized state.

As the heat input by the recirculating bed solids to the drying process according to the present invention is controlled on the basis of required drying capacity, a simplification of the dryer construction is attained, because all heat transfer surfaces can be omitted from the dryer. In other words, the heat transfer capability conventionally necessary in a dryer is replaced by a control scheme which regulates the heat input to the dryer. In this respect the invention is not basically focused on drying with steam as such, which is already implemented in several commercial applications, but rather, on achieving a particularly advantageous dryer construction.

As noted above, a fluidized-bed boiler does not necessitate the drying of the firing fuel for reasons related to fuel combustion. A dryer can, however, give an economical edge also in energy generation if the exhaust steam from the drying process can be condensed. An additional benefit is gained therein that the volume of stack gases re-entering the furnace is reduced by the amount of condensed exhaust steam. Then, a smaller boiler can be used and boiler investment costs lowered.

According to the present invention, the drying of the fuel is carried out in a dryer adapted in the fuel feed line, prior to feeding the fuel to the boiler, using the hot solids of the fluidized bed for importing heat to the drying process. The bed solids are recirculated into the dryer adapted into the feed line only for such an amount as is necessary to match the heat content of the recirculated bed solids with the energy requirement for drying the fuel. The recirculation rate is controlled by a feedback signal from the temperature of the bed solids/fuel mix. The control arrangement can also employ other measurement signals related to the mix temperature such as the CO or moisture content of the mix. The control scheme is basically implemented by regulating the feed rate of the recirculated bed solids to the dryer.

The hot bed solids are mixed with the wet fuel so that the moisture contained in the fuel is evaporated at the drying temperature. The temperature of the bed solids/fuel mix is kept within a range in which the contained water is evaporated from the fuel, while avoiding pyrolysis of the fuel. Then, the drying temperature is dependent on the pressure prevailing in the drying process and the fuel being dried. At atmospheric pressure the drying temperature is typically approx. 110° C. Excessive heating of the mix is avoided by regulating the feed rate of the bed solids into the dryer and by effective mixing of the bed solids with the wet fuel in the dryer. The mix is fed into the furnace of the fluidized-bed boiler via conventional fuel feed nozzles.

By virtue of employing the inert fluidized-bed solids for importing heat to the drying process, the so-called exhaust steam from the drying process is obtained for recovery use as an nearly clean steam whose condensing temperature is very close to the drying temperature.

The way of importing heat to the drying process results in a particularly advantageous dryer, because heat input to the dryer takes place in an efficient manner through the mixing of the bed solids with the fuel in the dryer. Also the bed solids cooled in the dryer heat up rapidly when returned to the hot fluidized bed of the furnace and mixing into the bed.

In principle the dryer can be constructed as any closed, gas-tight mixer in which the hot bed solids and the wet fuel can be effectively mixed with each other. A feasible alternative is a fluidized-bed dryer fluidized by means of the recirculated exhaust steam. The effective internal heat transfer capability of the dryer's fluidized bed guarantees a homogeneous temperature profile of the dryer, while the stable heat content of the fluidized bed prevents overheating of the fuel during temporary feed disturbances to the drying process.

A dryer according to the invention can be adapted to both a bubble-type fluidized-bed boiler and a circulating fluidized-bed boiler. When applied to a circulating fluidized-bed boiler, a portion of the circulating solids are routed to the dryer, wherefrom the mix of the dried fuel and the cooled circulating solids are returned to the boiler furnace via, e.g., the return nozzle of the circulating solids.

The dryer according to the invention obtains the heat for its drying process from the furnace, so no major changes in the dimensioning of the boiler's fluidized bed are required due to the novel drying arrangement. Boiler dimensioning is, however, affected therein that the volume of stack gases is reduced, because the exhaust steam generated in the drying process is omitted from the stack gases. If the fuel dryer is adapted to a new fluidized-bed boiler, the convection area of the boiler as well as the size of the electrostatic stack gas scrubber can be reduced.

More specifically, the method according to the invention is principally characterized by what is stated in the characterizing part of claim 1.

Furthermore, the apparatus according to the invention is characterized by what is stated in the characterizing part of claim 9.

The method and apparatus according to the invention provide multiple benefits. The employed drying method facilitates the implementation of a drying system featuring a particularly advantageous construction and cost. The cost of the novel dryer system remains as low as approx. 10 . . . 20% in comparison with existing alternatives.

The dryer system according to the invention can be employed for generating exhaust steam which can be utilized in an energy generating process. For instance, in a fluidized-bed boiler fired with a peat fuel having a moisture content of 50%, the exhaust steam from the dryer can be generated at 1 bar pressure for use in the turbine circuit of the power plant process. The energy of the exhaust steam can be utilized in district heating, as process steam or in electric power generation. In the generation of district heating energy or process steam, the increase in the net heat output is approx. 13.3% relative to the fuel-heat input power to the boiler, and in electric energy generation, approx. 1.7% relative to the fuel-heat input power.

As noted above, the size of the boiler can be reduced, because the exhaust steam generated in the drying process of the fuel is omitted from the stack gases to be exhausted from the boiler. For the example given above, the boiler size reduction is approx. 15 . . . 20%.

BRIEF DESCRIPTION OF THE DRAWINGS

The invention is next examined in greater detail by reference to the annexed drawings, in which.

DETAILED DESCRIPTION OF THE INVENTION

Figure 1:
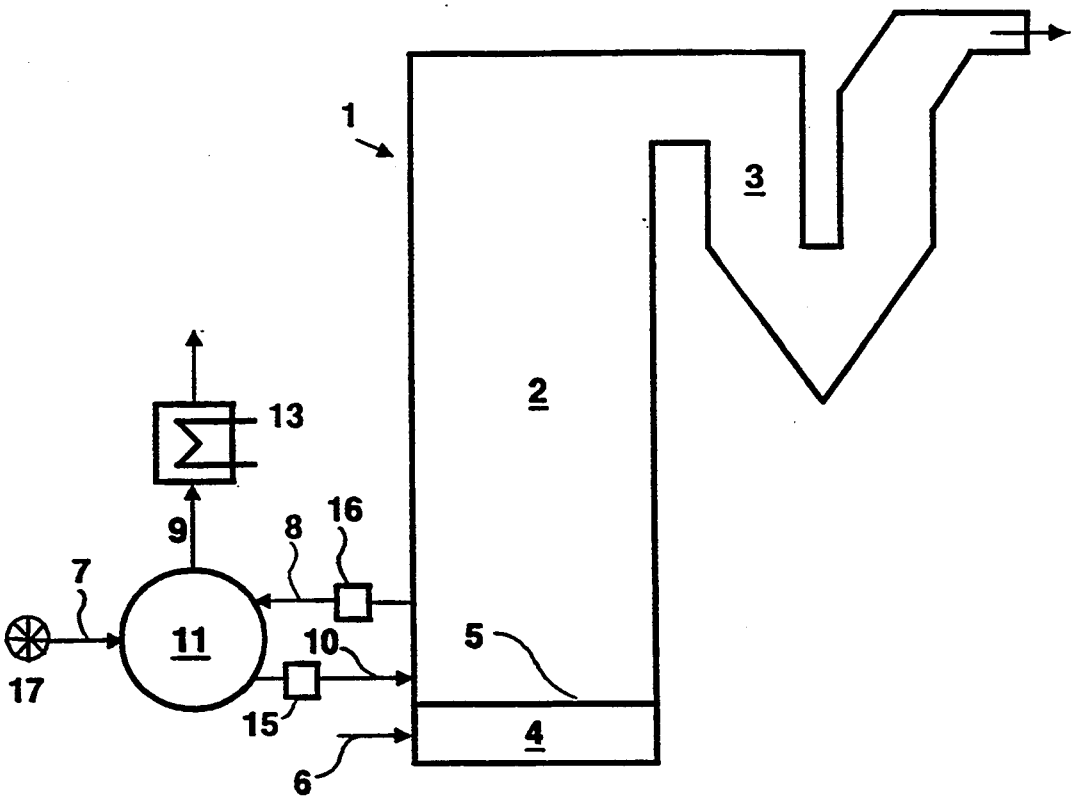
FIG. 1 illustrates diagrammatically the drying process and apparatus according to the invention.

In the process illustrated in FIG. 1, wet fuel such as peat, for example, is dried by way of the method according to the invention in a simple mixing-bed dryer and the nearly clean steam generated in the drying process is utilized in energy generation. The drying process in the exemplifying application operates at atmospheric pressure. The apparatus is comprised of a fluidized-bed boiler 1 with a furnace 2, an air inlet manifold 4 and an air distribution grate 5, as well as a stack 3, a dryer 11, a fuel feed line 7 and a fluidizing air inlet line 6 of the fluidized-bed boiler. Furthermore, the apparatus incorporates a feed nozzle 8 for the recirculated fluidized-bed solids, a return nozzle 10 for the mix of the fluidized-bed solids and the fuel, a recovery pipe 9 for the exhaust steam released from the drying of the fuel, and a condenser 13, control elements 15 and 16 for regulating the fuel and bed solids flows, and a fuel feed control element 17.

High-moisture peat is fed along the fuel feed line 7 to the dryer 11. The hot, inert bed solids, comprised of sand in this case, are recirculated from the fluidized-bed boiler 1 at 400°. . . 1000° C., advantageously at 800°. . . 900° C., via an inlet nozzle 8 to the dryer. The amount of the entering recirculated solids is regulated by means of the control element 16 so that the heat content imported by the bed solids recirculated via the dryer 11 corresponds to the energy consumed in the drying process. The drying energy need and control are described below in greater detail.

In the dryer 11 the fluidized-bed solids are mechanically mixed with the fuel. Heat transfer occurs efficiently, as the bed solids make a direct contact with the fuel.

When mixing with the bed solids, the fuel is dried and steam is generated. Because solids from the boiler bed alone can enter the dryer besides the fuel, the exhaust steam generated in the drying process is nearly clean, typically containing approx. 2 . . . 5% inert gases. Therefore, the exhaust steam can be readily condensed and its heat of condensation recovered.

The exhaust steam is routed from the dryer 11 along the line 9 to further use, in this example to the condenser 13, where its heat of condensation is recovered. Due to the low content of inert gases, the condensation temperature of the steam is very close to the temperature employed in the drying process. The heat of condensation can be advantageously utilized in district heating or in a power plant process as process steam and/or electric energy generation in, e.g., preheating of feed water, preheating of combustion air or in heat exchangers of district heating circuits.

The mix of the dried fuel and the bed solids is fed from the dryer 11 via the nozzle 10 into the boiler furnace 2, wherein the bed solids cooled in the dryer heat up rapidly when mixing into the hot fluidized bed of the furnace.

The recirculation rate of the bed solids is controlled according to the invention so that the heat content of the recirculated solids corresponds to the heat input need of the drying process in the dryer 11. In the example discussed herein, the recirculation rate is regulated by means of the control element 16, which typically is a gate or a so-called lock-hopper feeder. The feedback signal for steering the control element is taken from the temperature of the bed solids/fuel mix contained in the dryer 11, whereby a suitable set value for the temperature is adjusted dependent on the internal pressure of the dryer and quality of fuel being dried. In an atmospheric-pressure drying process for peat fuel, the temperature set value is typically approx. 110° C. The dryer 11 temperature is monitored with the help of thermometer. Besides temperature, any other temperature-related process variable can be measured to obtain a feedback signal. According to this scheme, the control element 16 admits only so much of the hot bed solids into the dryer 11 as is necessary to maintain the dryer temperature constant at the desired level with the help of the heat imported in the entering solids. If the internal temperature tends to increase, the control element 16 restricts the solids flow into the dryer, and the temperature is thus maintained constant. Correspondingly, the bed solids recirculation rate is increased if a temperature drop is detected.

The internal temperature of the dryer 11 must be slightly higher than the saturation temperature of the exhaust steam evaporated from the fuel at the pressure prevailing in the dryer, while on the other hand, not so high as to initiate the pyrolysis of the fuel. These boundary conditions are thus those that limit the allowable temperature operating range for the dryer 11, that is, for the bed solids/fuel mix.

In this exemplifying embodiment the temperature is monitored with the help of thermometer placed in the dryer 11. Alternatively, the mix temperature can be measured at the nozzle 10 or the steam temperature at the nozzle 9, since there two temperatures are essentially equal.

The dryer 11 described in this example is a simple and low-cost mixer apparatus requiring no separate heat transfer surfaces. Regulation of the heat content imported along the entering bed solids prevents overheating of the dryer 11, and thence the temperature in the dryer is maintained in the exemplifying embodiment within approx. 100°. . . 150° C., or simply, approx. 0°. . . 50° C. above the saturation temperature of the released exhaust steam.

The drying process can also be pressurized, whereby both the fluidized-bed boiler and the dryer are operated at equal pressure, or even having a positive pressure in the dryer relative to the boiler pressure. If the dryer is operated at a positive pressure relative to the boiler, both control elements 15 and 16 are employed to perform as pressure-tight gates between the boiler and the dryer. In this case the control elements must be either of the so-called lock-hopper feeder type, or alternatively, pressurized gate feeders. The internal temperature of the dryer is approx. 0°. . . 50° C. above the saturation temperature of the exhaust steam released from the fuel in the dryer 11 at the operating pressure.

In the alternative embodiment illustrated in FIG. 1, the control element 16 has been eliminated by placing the dryer at a lower elevation relative to the boiler. The amount of bed solids recirculated via the nozzle 8 is regulated by means of the control element 15, using the temperature of the bed solids/fuel mix travelling along the line 10 as the feedback signal corrected with the mass rate balance of the dryer. The control element 15 typically is a pressurized gate feeder or a feed auger, whose rotation speed is regulated on the basis of the temperature of the bed solids/fuel mix conveyed by the auger. Therefore, the mix temperature is appropriately monitored at this point. As the mass flow of the mix exiting the dryer tends to reduce the amount of the mix contained in the dryer, more hot solids can enter the dryer via the nozzle 8 as much as the dryer can admit. When the dryer is full, the inlet flow of the bed solids ceases. Simply, if the temperature of the mix travelling along the line 10 tends to rise excessively high, the mass flow along the line 10 is reduced by means of the control element 15, and simultaneously, the dryer fills up, whereby the inlet flow of the hot bed solids to the dryer via the line 8 is ceases. In this manner the recirculation of the bed solids is regulated with the control element 15, whose-operation is controlled on the basis of the temperature of the mix travelling along the line 10.

Figure 2:
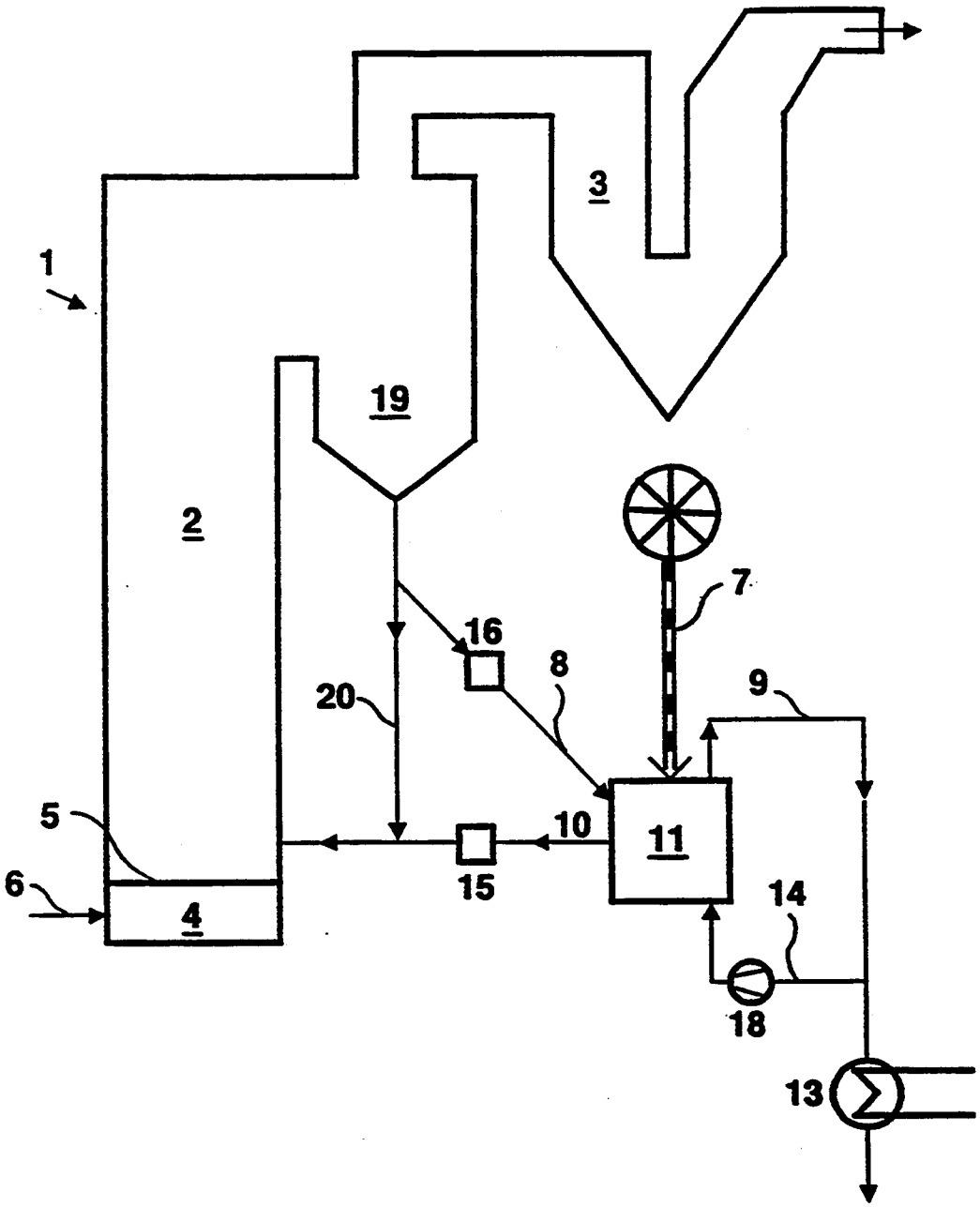
FIG. 2 illustrates an embodiment in which the boiler is a circulating fluidized-bed boiler and the dryer is a fluidized-bed dryer with a construction designed to recirculate a portion of the steam generated in the drying process back to the dryer for fluidizing the dryer bed.

FIG. 2 illustrates an embodiment, in which the boiler 1 is a circulating fluidized-bed boiler and the dryer 11 is a fluidized-bed dryer. A portion of the exhaust steam released in the drying process is recirculated and used for fluidizing the dryer bed. As described in the first example above, a required amount of the hot bed solids for drying the fuel is recirculated from the boiler 1 via the control element 16 along the line 8 to the dryer 11. The fuel entering the dryer via the line 7 is mixed in the dryer with the bed solids.

Heat transfer between the fuel particles and the bed solids within the fluidized bed of the dryer 11 takes place effectively, and the bed temperature remains close to the phase transition temperature of the evaporating steam, that is, approx. 10°. . . 20° C. above the saturation temperature of the steam.

The steam released in the drying process is routed along the line 9 to further use. A portion of the steam is recirculated along the line 14 back to the dryer 11, where it is used for fluidizing the bed solids/fuel mix. The pressure of the recirculated steam is elevated with the help of a booster fan 18. The other portion of the exhaust steam from the dryer is taken to further use, in this example, to the condenser 13.

The circulating solids are routed from the boiler 1 to a cyclone 19, after which a portion of the circulating solids are routed via the control element 16 to the dryer 11. The rest of the circulating solids are returned directly to the boiler via a nozzle 20. The mix of the dried fuel and the cooled circulating solids is returned back to the furnace 2 via the line 10. The circulation rate control of the bed solids entering the dryer 11 is arranged in the same manner as in the example illustrated in FIG. 1. Also in the exemplifying embodiment illustrated in FIG. 2 here, the control element 16 can be eliminated, whereby the flow regulation takes places with the help of the control element 15 in the abovedescribed manner.

Furthermore, in both examples illustrated in FIGS. 1 and 2 the fuel-heat input can be regulated to match the required heat output of the boiler with the help of a fuel feed control element placed on the line 7, whereby said control element can be, e.g., a feed auger or a so-called lock-hopper feeder.

The invention is not limited to applications in electric utility plants, but rather, it can be employed in conjunction with all fluidized-bed boilers of the above-described kind.

The fuel to be dried can also be peat or any other wet fuel such as coal, brown coal, sewage sludge, biomass or a similar combustible material.

I claim:

1. A method for improving the energy economy in drying the fuel used for firing a fluidized-bed boiler (1), comprising the steps of:

recirculating hot bed solids from a boiler furnace of the fluidized-bed boiler (1) to a dryer (11) incorporated into a fuel feed line, mixing the fuel in the dryer (11) with the bed solids and drying the fuel, whereby steam is released from the fuel, feeding the mix of the dried fuel and bed solids into the fluidized-bed boiler (1), controlling the recirculation rate of the bed solids such that the temperature of the bed solids/fuel mix in the dryer (11) is kept above the saturation temperature of the steam, yet below the pyrolysis temperature of the fuel, and routing the nearly clean steam generated in the drying process from the dryer (11) to useful applications.

2. A method as defined in claim 1, wherein the drying process is under pressure.

3. A method as defined in claim 1, wherein the recirculation rate control is implemented by regulating the amount of recirculated bed solids entering the dryer.

4. A method as defined in claim 3, wherein the recirculation rate control is implemented by means of a control element (15) and/or (16).

5. A method as defined in claim 1, wherein the operating temperature of the dryer (11) is maintained 0°–50° C. above the saturation temperature of the steam generated in the drying process.

6. A method as defined in claim 1 wherein the steam generated in the drying process is condensed.

7. A method as defined in claim 1, wherein the steam generated in the drying process contains a maximum of 5% inert gases.

8. A method as defined in claim 1, wherein the fuel to be dried is a water-containing fuel such as peat, coal, brown coal, sewage sludge, or biomass.

9. An apparatus for drying fuel used for firing a fluidized-bed boiler (1), said apparatus comprising a fluidized-bed boiler (1), a fuel dryer (11), which is a fluidized-bed dryer, a nozzle (8) for recirculating bed solids from the boiler to the dryer, a nozzle (10) for feeding the mix of the fuel with the bed solids from the dryer to the boiler, control elements (16) and/or (15) for regulating the amount of recirculated bed solids entering the dryer, a nozzle (9) for recirculating a portion of the steam generated in the drying process to the dryer (11) to act as a fluidizing gas, and no separate heat transfer surfaces in the dryer (11).

10. An apparatus as defined in claim 9, wherein said dryer (11) is pressurized.

* * * * *